United States Patent [19]

Chaboseau et al.

[11] 4,207,754

[45] Jun. 17, 1980

[54] AIRCONDITIONING SYSTEM SUITABLE FOR RESIDENTIAL USE

[75] Inventors: Jean Chaboseau; Andre Regef, both of Paris, France

[73] Assignees: Cem Compagnie Electro-Mecanique; Centre Scientifique et Technique du Batiment, both of Paris, France

[21] Appl. No.: 868,746

[22] Filed: Jan. 12, 1978

[30] Foreign Application Priority Data

Dec. 1, 1977 [FR] France ..... 77 00708

[51] Int. Cl.[2] ..... F25D 9/00

[52] U.S. Cl. ..... 62/402

[58] Field of Search ..... 62/86, 87, 88, 401, 62/402

[56] References Cited

U.S. PATENT DOCUMENTS

| | | | |
|---|---|---|---|
| 1,965,733 | 7/1934 | Chamberlain | 62/88 |
| 2,477,931 | 8/1949 | King | 62/87 |
| 2,485,590 | 10/1949 | Green | 62/87 |

*Primary Examiner*—Ronald C. Capossela

*Attorney, Agent, or Firm*—Burns, Doane, Swecker & Mathis

[57] ABSTRACT

An airconditioning system includes a heat exchanger having high and low temperature heat exchange chambers in which a fluid is cooled or heated, respectively. An air circuit is associated with each chamber. A register having four orifices and a valve is associated with each air circuit, and the system can easily be switched from a heating to a cooling mode, or vice versa, by actuation of the valves to cause the air entering the environment to be conditioned to flow through a selected one of the two air circuits.

16 Claims, 13 Drawing Figures

AIRCONDITIONING SYSTEM SUITABLE FOR RESIDENTIAL USE

BACKGROUND OF THE INVENTION

This invention relates to airconditioning systems in general, and more particularly to airconditioning systems suited for residential use.

A single-fluid heating system is known in the prior art. One such system is described in Houbrecht's "Thermodynamique theorique," 2nd edition, 1972, pp 221–226.

Such a heating system is illustrated with regard to FIG. 1 and comprises a compressor 1 which draws used air at temperature t1 through an evacuation duct 2 from a residence L which requires heating. The temperature of this air is raised by quasi-adiabatic compression to a temperature t2 and forced through a conduit 3 into the high-temperature chamber 41 of a heat exchanger 4. In the high temperature chamber 41 it cools to a temperature t3 by giving up its heat to fresh air from the atmosphere A which is at an outside temperature t5. This fresh air is taken from the atmosphere A through a duct 6 and is made to circulate in the low-temperature chamber 42 of the heat exchanger 4 by a blower 11. The output rate of the blower 11 is equal to that of the compressor 1, so that the rate of flow of air through each chamber 41, 42 of the heat exchanger 4 is equal to that of the other. In the present context, the high-temperature chamber 41 of the heat exchanger 4 is the one in which the relatively hot fluid to be cooled is circulated, and the low-temperature chamber 42 is the one in which the relatively cold fluid to be heated is circulated.

The heated fresh air leaves the heat exchanger 4 and enters the residence L which is to be heated through a duct 7 and at a temperature t6 higher than temperature t1. The overall conditions relating to the heat exchanger 4 are such that $t2-t6=t5$. The used air from residence L is cooled to temperature t3 and then allowed to expand through a turbine 8 to deliver work. The air is then expelled into the atmosphere A through a duct 9 and at a temperature t4 less than outside temperature t5.

The turbine 8 is coupled to the compressor 1 and contributes to driving the compressor 1 together with a motor 10. The blower 11 may be made to rotate by a separate motor or by the motor 10 and/or the turbine 8.

FIG. 2 shows the successive states of the air circulating in the heating system illustrated in FIG. 1 as a function of coordinates t (temperature) and S (entropy). The used air removed from residence L at temperature t1 is subjected to adiabatic compression raising it to temperature t2 in compressor 1. This air arrives at the high temperature chamber 41 of the heat exchanger 4 where it is cooled from t2 to t3 and then allowed to expand through the turbine 8 to be expelled at temperature t4 into the atmosphere A, through the outlet conduit 9, where t4 is less than the outside temperature t5.

The fresh air taken in inlet conduit 6 from the atmosphere A at temperature t5 is raised to the required temperature t6 in the low temperature chamber 42 of exchanger 4 and then is injected at 7 into residence L at this temperature in order to provide the desired temperature.

OBJECTS AND BRIEF SUMMARY OF THE INVENTION

The present invention relates to improving this known heating system, and its object is to improve it and to adapt it to the airconditioning of residences.

It is a further object of the invention to provide an airconditioning system which can be switched between heating and cooling modes with minimal movement of parts.

It is an additional object of the invention to utilize some of the heat produced by an airconditioning system to heat water for domestic purposes.

In accordance with these objects, the air-conditioning system of a residence comprises two separate air circuits, one of which includes a compressor unit in series with a first chamber of a heat exchanger and a turbine, and the other air circuit includes a second chamber of said heat exchanger. A register having four orifices and two operational positions is provided in each air circuit. In a first operational position, used air extracted from the residence circulates in a given first of the two air circuits and fresh air from the atmosphere circulates in a given second of the two circuits for a heating mode known per se. In the second operational position used air removed from a residence circulates in said second air circuit while fresh air from the atmosphere circulates in said first circuit for the cooling mode.

In a first embodiment of the present invention, the compressor unit, the first chamber of the heat exchanger and the turbine are arranged in series in the direction of flow of the air in a known manner known to form the first air circuit. The second heat exchange chamber is included in the second air circuit. The first and second heat exchange chambers respectively are labelled as the high and low temperature chambers. The first register is connected to the ends of the first air circuit, in the first operational position, to provide for residential used air intake at the compressor and expulsion of the turbine discharge air into the atmosphere. In the second operational position, the first register provides for atmospheric fresh air intake at the compressor and supplies the residence with the turbine discharge air. The second regiater is connected to the ends of the second air circuit and provides, in the first operational position, for atmospheric fresh air intake at the second heat exchange chamber and discharge into the residential area. In the second operational position, the second register provides for residential used air intake in the second chamber and expulsion of the air leaving this second chamber into the atmosphere.

In a second embodiment of the present invention, the second heat exchange chamber of the heat exchanger is included in the first air circuit. The turbine, the first heat exchange chamber and the compressor unit are arranged in series in that order and in the direction of air flow and form the second air circuit. The first and second heat exchange chambers in this case are the low and high temperature chambers, respectively. Under such conditions the first register can be connected to the ends of the second air circuit to provide, in the first operational position, for atmospheric fresh air intake at the turbine and forced injection of the air discharged by the turbine into a residence. In the second operational position, used residential air intake is at the turbine and expulsion of the air discharged by the compressor is into the atmosphere. The second register is connected to the ends of the first air circuit to provide, in the first operational position, for residential used air intake is at the second chamber and expulsion of the air discharged from this chamber into the atmosphere. In the second operational position, atmospheric fresh air intake is at the second chamber and injection of the air discharged from this chamber is into the residence.

According to another feature of the present invention, the heat exchanger may be divided into several segments and a humidifier may be placed between any two of such segments.

The invention offers the advantage of preserving the same mode of operation for the heat exchangers for each of the two functions, i.e. remaining either high temperature or low temperature. Furthermore, it requires the actuation of only two registers to switch between heating and cooling.

BRIEF DESCRIPTION OF THE DRAWINGS

The invention will be understood more clearly with regard to the preferred embodiments illustrated in the drawings wherein.

DESCRIPTION OF THE PREFERRED EMBODIMENTS

Figure 1:
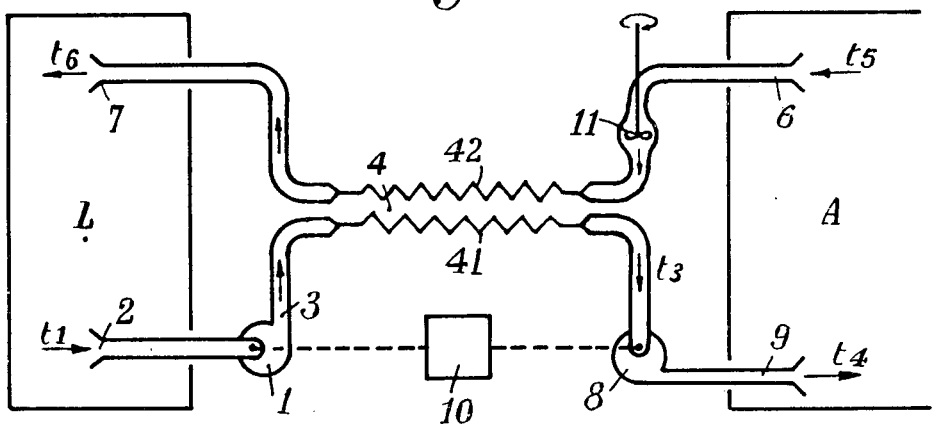
FIG. 1 is a schematic illustration of the previously described, prior art heating system.
Figure 3:
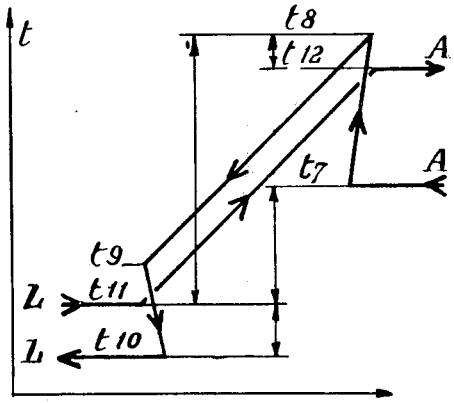
FIG. 3 is a temperature-entropy graph showing the successive states of the air circulation in the system of the present invention for the cooling mode.
Figure 5:
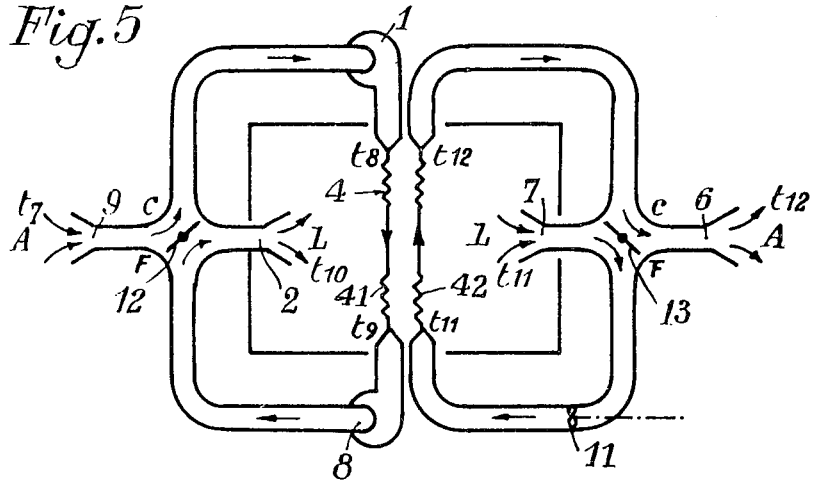
FIG. 5 illustrates the system of FIG. 4 in the cooling mode.

The system illustrated in FIG. 1 may be modified to cool a residence L as well, in accordance with the present invention. Referring to FIGS. 3 and 5, the fresh air is taken in through the conduit 9 at outside temperature t7 using the compressor 1. The air is raised to a temperature t8 in the compressor 1 and then cooled in the first high temperature chamber 41 of the heat exchanger 4 to temperature t9. The air is expanded in the turbine 8, cooling it further to a temperature t10 less then temperature t11 of the residence, and delivered through the conduit 2 into the residence L, thus cooling the residence.

The used air is drawn out through the conduit 7 in the residence L at temperature t11 by a blower 11. This air is heated by circulating it in the second low temperature chamber 42 of the heat exchanger 4 and then expelled through the conduit 6 into the atmosphere at a temperature t12 higher than the outside temperature t7.

Figure 2:
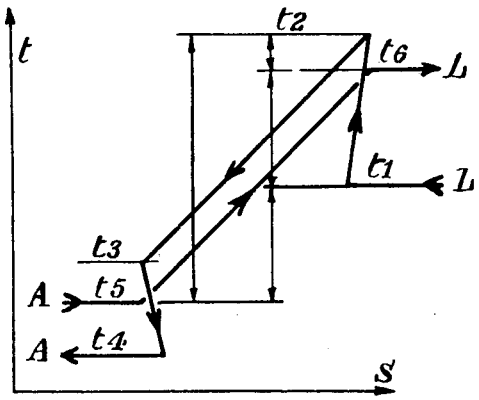
FIG. 2 is a temperature-entropy graph showing the successive states of the air circulating in the heating system of FIG. 1.
Figure 4:
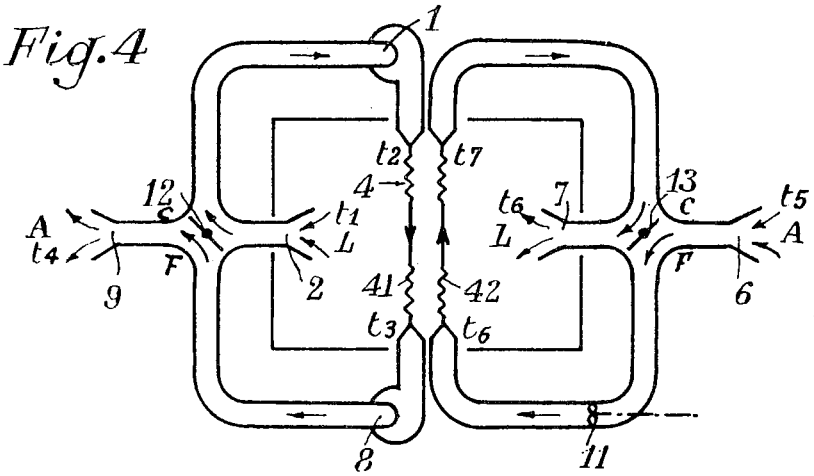
FIG. 4 is a schematic illustration of a first embodiment of the present invention in the heating mode.

FIGS. 4 and 5 illustrate the two operational modes of the system of the first embodiment for heating and cooling, which correspond, respectively, to the functional charts of FIGS. 2 and 3. The direction of airflow in the system's two air circuits is indicated by the arrows of FIGS. 4 and 5.

First and second registers 12 and 13 are each provided with four orifices and a butterfly-type valve. When in the operational heating position C (FIG. 4), the first register 12 draws in, through the conduit 2, the used air from the residence L and moves it through the air circuit comprising the compressor 1, the high temperature chamber 41 of the heat exchanger 4 and the turbine 8, and expels it through the conduit 9 into atmosphere A. The second register 13 draws in the fresh outside air through the circuit 6 using the blower 11 and circulates it through the low temperature chamber 42 of the heat exchanger 4 to heat it and then discharge it into residence L through the conduit 7.

FIG. 5 shows the two registers 12 and 13 switched into position F for cooling to allow the first register to draw in outside air through the conduit 9 by means of the compressor 1. It passes through the high temperature chamber 41 of the heat exchanger 4 and expands in the turbine 8. The air is introduced in the cooled state through the conduit 2 into residence L. The second register 13 moves the air drawn through the conduit 7 from the residence L by means of the blower 11. It is heated in the low temperature chamber 42 of the heat exchanger 4 and expelled through the conduit 6 into the atmosphere A at a temperature exceeding the outside temperature.

Figure 6:
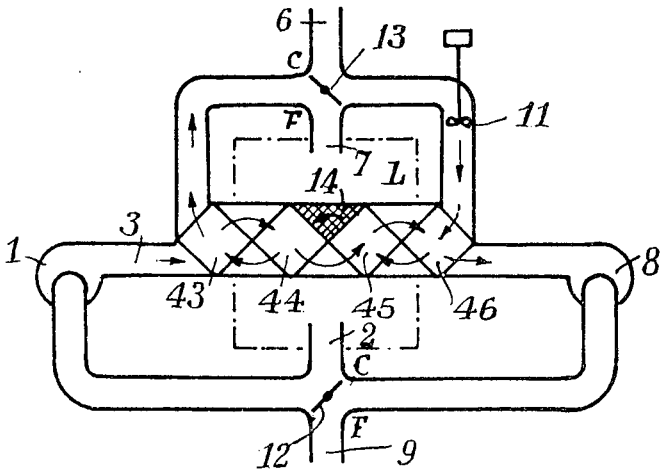
FIG. 6 is the schematic illustration of the system of FIG. 4 with an associated humidifier.

FIG. 6 illustrates a variation in which the heat exchanger 4 is divided into several parts, for example, four parts 43, 44, 45 and 46. A humidifier 14 preferably located between two of the pairs 43–46 is disposed in the path of the air drawn in through the conduit 6 by the compressor unit 11. The humidifier 14 has been placed in the path of the fresh air at the center of the heat exchanger 4. It will be obvious that it can be placed nearer one of the ends of the heat exchanger 4. It is preferable that the humidified air pass through at least one component of the heat exchanger 4 to remove excess moisture therefrom.

Figure 7:
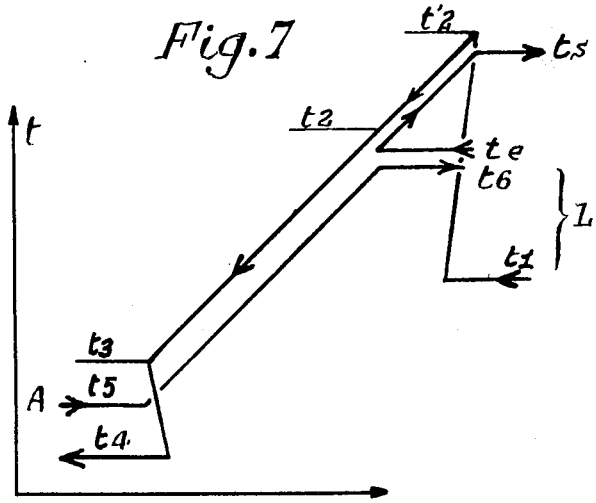
FIG. 7 is a temperature-entropy graph for a system which includes a device for heating water for residential use.

FIG. 7 illustrates a modified operation of the previously described system. With regard to the operational charts of FIGS. 2 and 3 the air obtained from the compressor 11 is compressed more than in the conventional systems. The excess temperature $t'2-t2$ obtained thereby may be put to use by making the air leaving the compressor 1 pass first through an auxiliary air-water heat exchanger to change the temperature of a flow of water from $t_e$ to $t_s$ so as to obtain hot water for domestic needs. This advantage can be obtained when the invention is operating either as a heating or a cooling system.

To achieve this advantage, the heat exchanger 4 may be designed to include a third chamber (not shown) containing water and located between the two chambers 41 and 42 at least along part of the length of the heat exchanger 4.

Figure 8:
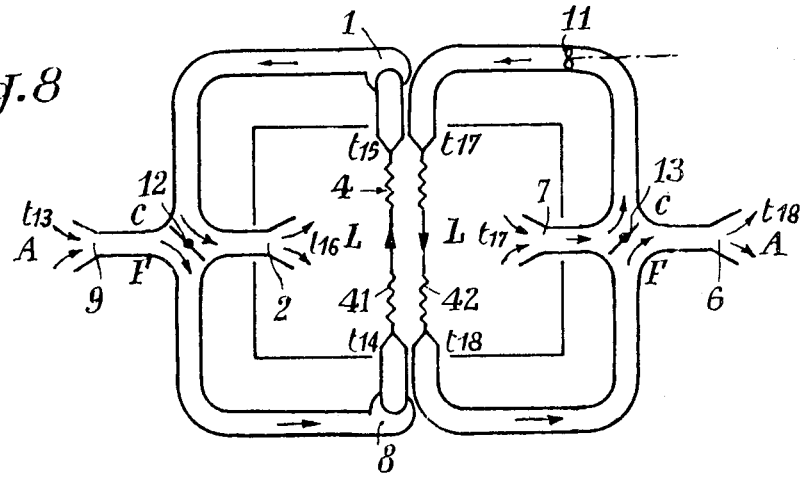
FIGS. 8 and 9 are schematic illustrations of a second embodiment of the present invention in the heating and cooling modes, respectively.
Figure 9:
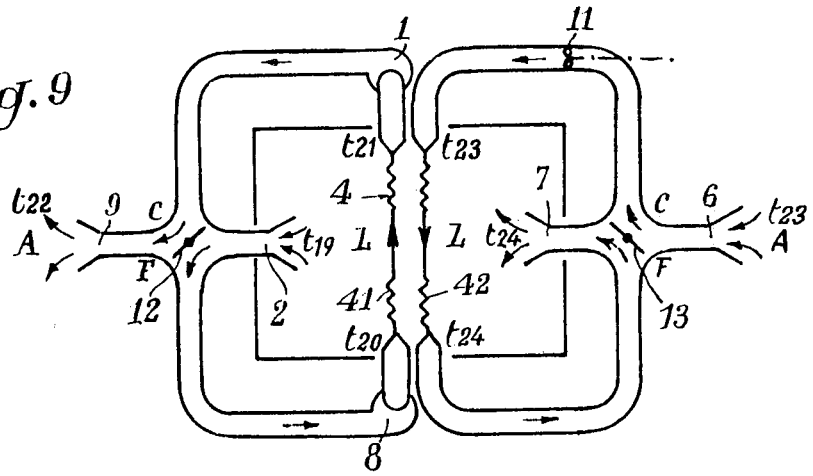

A second embodiment of the present invention is illustrated in FIGS. 8 and 9. The first chamber 41 of the heat exchanger 4 is located between the output port of the turbine 8 and the intake port of the compressor 1. Consequently, this chamber 41 is at a lower pressure than the second chamber 42 of the heat exchanger, which is at atmospheric pressure. The compressor 1 and the turbine 8 are mounted in such a manner that the air is made to move in the direction indicated by the arrows in FIGS. 8 and 9, which is in the opposite direction to that of the airflow in the circuits illustrated in FIGS. 4 and 5. Similarly, the blower 11 is mounted in the circuit comprising the second chamber 42 of the heat exchanger 4 in order to insure that the air circulates in chamber 42 in the direction opposite that of the airflow in the corresponding circuit of the system illustrated in FIGS. 4 and 5.

In the first embodiment illustrated in FIGS. 4 and 5, the chambers 41 and 42 of the heat exchanger 4 are the high and low temperature chambers, respectively. However, for the second embodiment illustrated in FIGS. 8 and 9, the chambers 41 and 42 are the low and high temperature chambers, respectively.

Referring to FIG. 8, the two registers 12 and 13 are in the operational C position for the heating mode, which will be described with reference to FIG. 10. In this mode, the fresh air is drawn in through the conduit from the atmosphere A and at the outside temperature t13. This air intake is achieved by means of the compressor 1 and conveyed through turbine 8 and the low temperature chamber 41 of the heat exchanger 4. When it passes through the turbine 8, this fresh air expands and cools to temperature t14. Then it is raised from temperature t14 to t15 while passing through the low temperature chamber 41 of the heat exchanger 4, where it absorbs the heat given up by the air circulating through the high temperature chamber 42 of the heat exchanger 4. The air is raised to temperature t15 and drawn in by compressor 1. Inside the compressor 1 it is again raised by quasi-adiabatic compression to a temperature t16, after which it is discharged through the conduit 2 into the residence L at temperature t16 which is higher than that, t17, of the residence.

The used air at temperature t17 of the residence L is drawn in through the conduit 7 by the blower 11. It circulates in the high temperature compartment 42 of the heat exchanger 4 where it gives up its heat, thereby lowering its temperature from t17 to t18. It is then expelled through the conduit 6 into the atmosphere A at temperature t18 which is less than the outside temperature t13.

FIG. 9 illustrates the registers 12 and 13 in the F position for the cooling mode which will be described with reference to FIG. 11. In this mode, the used air is drawn in through the conduit 2 from the resistance L at temperature t19 by the compressor 11 through the turbine 8 and the low temperature chamber 41 of the heat exchanger 4. While passing through the turbine 8 the used air expands and cools to temperature t20. Upon leaving the turbine 8 it is reheated from t20 to t21 while passing through the low temperature chamber 41 of the heat exchanger 4 where it absorbs the heat given up by the air circulating in the high temperature chamber 42 of the heat exchanger. The air raised to temperature t21 is drawn in by the compressor 1 in which it is further raised to temperature t22 by quasi-adiabatic compression, and thereafter it is expelled through the conduit 9 into the atmosphere A at temperature t22 which exceeds the outside temperature t23. The fresh outside air at temperature t23 is drawn in through the conduit 6 from the atmosphere A by the blower 11. It is passed through the high temperature chamber 42 of the exchanger 4 where it gives up its heat and cools to temperature t24. The fresh air so cooled to temperature t24 is discharged through the conduit 7 into the residence L at temperature t24 which is lower than that t19 of the residence, whereby the latter is cooled.

As in the case of the system illustrated in FIGS. 4 and 5, the system illustrated in FIGS. 8 and 9 may include a humidifier. However, in this case, the humidifier must be preferably located downstream of the compressor 1. The embodiment illustrated in FIGS. 8 and 9 may also comprise an auxiliary water-air heat exchanger to obtain hot water in a manner similar to that described in relation to FIG. 7.

The control of thermal output (heating or cooling) may be achieved by varying the compressor rate both for the system illustrated in FIGS. 4 and 5 and for that of FIGS. 8 and 9.

It will be noted upon comparing FIGS. 4 and 5 that, in the heating mode, ducts 2 and 6 assume the role of intake ducts for the air circuits and ducts 7 and 8 that of exhaust ducts, while in the cooling mode, such roles are reversed. The same applies to the system illustrated in FIGS. 8 and 9. However, this may be a drawback when filters are inserted into the air circuits, for instance at the location of said ducts, because in some cases the dust accumulating on one side of those filters during one operational mode might be reintroduced into the air circuits or the residence during the other operational mode. This drawback may be eliminated by the third embodiment described with reference to FIGS. 12 and 13.

Figure 12:
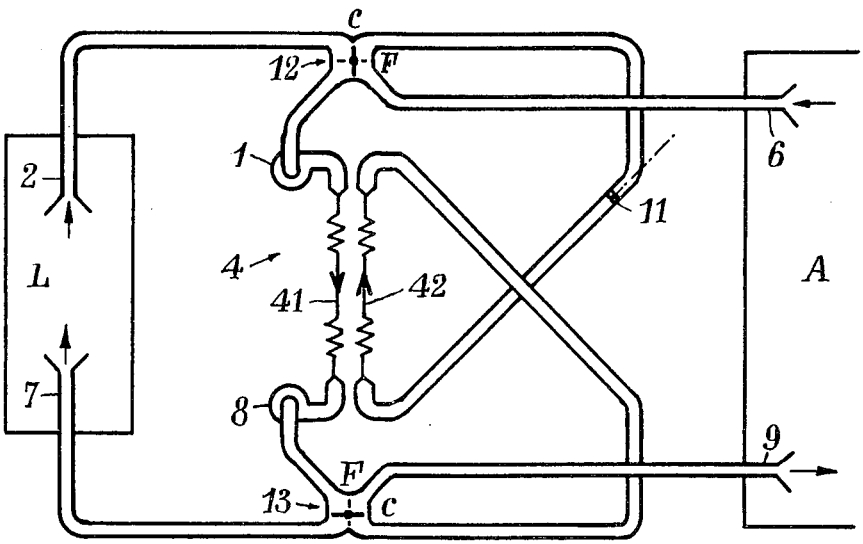
FIG. 12 is a schematic illustration of a third embodiment of the present invention.

FIG. 12 illustrates the system of the third embodiment operating on the same principles as that illustrated in FIGS. 4 and 5, that is, according to the entropy-temperature graphs of FIGS. 2 and 3. In the heating mode, C, of this system, wherein the butterfly valve is in the solid line position, register 12 joins the intake of the air circuit 1, 41, 8 to duct 2 and the intake of the chamber 42 to the duct 6 in such a manner as to achieve intake of the used air through the duct 2 from the residence L at the compressor 1 and intake of the fresh air through the duct 6 from the atmosphere at chamber 42. In the cooling operational position F of the butterfly-type valve, shown in dashed lines, the ducts are connected so as to achieve intake of the fresh air drawn in through the duct 6 from the atmosphere A at the compressor 1 and intake of the used air drawn in through the duct 2 from the residence L at the chamber 42. Register 13 is joined to the exhaust of the air circuit 1, 41, 8, and to the exhaust of the chamber 42 and to ducts 7 and 9 in such manner as to achieve, in the heating operational position C of the butterfly-type valve, shown in solid lines, expulsion of the air discharged from the turbine 8 into the atmosphere through the conduit 9 and introduction of the air discharged from the chamber 42 into the residence L through the conduit 7. In the cooling operational position F of the butterfly-type valve, shown in dashed lines, the register 13 directs the air discharged from the turbine 8 to the residence L through the conduit 7 and expels the air discharged from the chamber 42 into the atmosphere A through the conduit 9.

Figure 10:
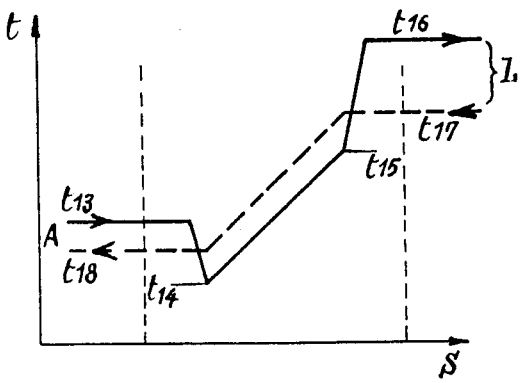
FIGS. 10 and 11 are temperature-entropy graphs showing the successive states of the air circulating in the systems of FIGS. 7 and 8 respectively for the heating and cooling modes.
Figure 11:
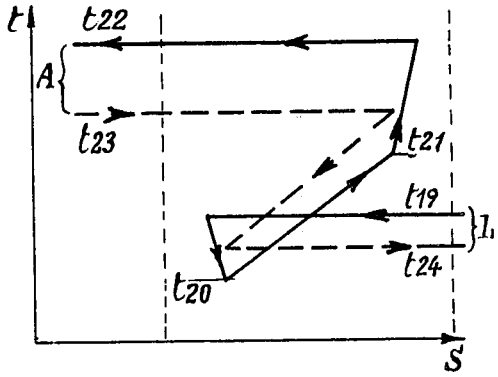
Figure 13:
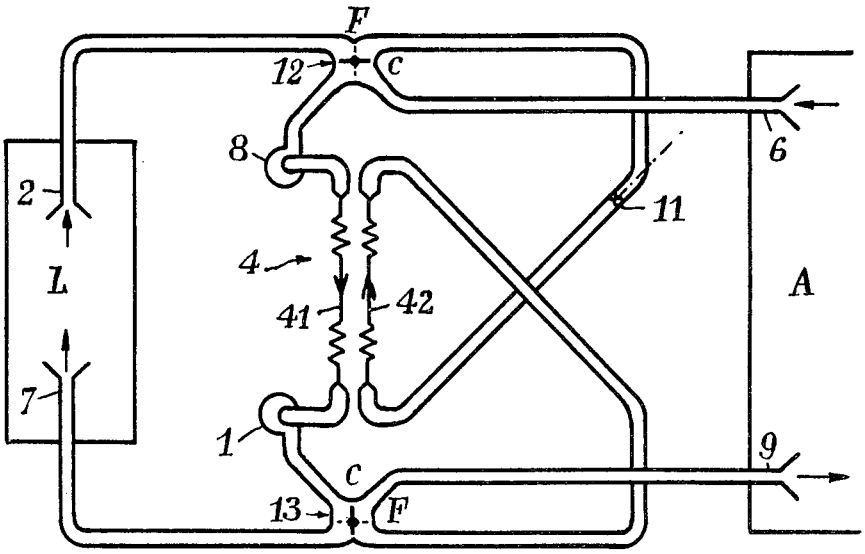
FIG. 13 is a schematic illustration of a fourth embodiment of the present invention.

FIG. 13 illustrates the system of the third embodiment operating on the same principles as that of FIGS. 8 and 9, that is, according to the temperature-entropy graphs of FIGS. 10 and 11. In the heating mode, the butterfly-type valve is in position C shown in solid lines. The register 12 joins the intake of the air circuit 8, 41, 1 to duct 6 and the intake of the second chamber 42 of the heat exchanger 4 to duct 2. The fresh air is drawn in from the atmosphere A through the conduit 6 to the turbine 8. The used air is drawn in from the residence L through the conduit 2 to the chamber 42. For the operational position F of the butterfly-type valve shown in dashed lines, i.e. the cooling mode, the used air is drawn in from the residence L through the duct 2 to the turbine 8. The fresh air is drawn in from atmosphere A through the duct 6 to the chamber 42. Register 13 is joined to the exhaust of the air circuit 8, 41 1 and to the exhaust of chamber 42 and to ducts 7 and 9 so as to achieve introduction of the air discharged from the compressor 1 into the residence L through the duct 7 and explusion of the air discharged from the chamber 42 into the atmosphere A through the duct 9 in the heating mode. In the cooling mode, register 13 achieves expulsion of the air discharged from the compressor 1 into the atmosphere A through the duct 9 and injection of the air leaving the chamber 42 into the residence L through the duct 7.

It is to be noted that each of the four ducts 2, 6, 7 and 9 of the systems of FIGS. 12 and 13 always assumes the same function regardless of whether the operational mode be heating or cooling.

The present invention may be embodied in other specific forms without departing from the spirit or essential characteristics thereof. For example, any other kind of register may be used in lieu of the butterfly-valve registers, for instance the slide-valve type. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An airconditioning system suitable for residential use comprising:

a first air circuit including a compressor unit in series with a first chamber of a heat exchanger and a turbine, the turbine, the first chamber of the heat exchanger and the compressor being arranged in series in that sequence in the direction of air flow;

a second air circuit comprising a second chamber of said heat exchanger, the first and second chamber being the relative low and high temperature chambers, respectively, of the heat exchanger;

first and second registers connected to the ends of said two air circuits, each register having four orifices and two operational positions; and, means for moving said first and second registers to first and second operational positions to respectively heat and cool an area, wherein in the first operational position of the registers, used air is withdrawn from an area to be heated and is circulated in said second air circuit and fresh air is drawn from the atmosphere and is circulated in said first air circuit and in the second operational position of said registers used air is withdrawn from an area to be cooled and is circulated in said first air circuit while fresh air is drawn from the atmosphere and is circulated in said second circuit.

2. An airconditioning system as defined in claim 1, wherein said compressor unit, said first chamber of said heat exchanger and said turbine are arranged in series in that sequence in the direction of the airflow to form said first air circuit, and said first and second chambers respectively are the relatively high and low temperature chambers of said heat exchanger.

3. An airconditioning system as defined in claim 2, wherein said first register is connected to the ends of said first air circuit to provide in the heating mode for intake of the used air from the area to be heated through said compressor and expulsion of the air discharged from said turbine into the atmosphere, and to provide in the cooling mode for intake of the fresh air from the atmosphere through said compressor and introduction of the air discharged from said turbine into the area to be cooled; and said second register is connected to the ends of said second air circuit to provide in the heating mode for intake of fresh air from the atmosphere through said second chamber and introduction of the air discharged from said second chamber into the area to be heated, and in the cooling mode to provide for intake of the used air from the area to be cooled through said second chamber and expulsion of the air discharged from said second chamber into the atmosphere.

4. An airconditioning system as defined in claim 2, wherein said first register is connected to the intake of said first air circuit and to the intake of second air circuit to provide in the heating mode for intake of the use air evacuated from the area to be heated through said compressor and intake of fresh air from atmosphere through said second chamber of said heat exchanger, and to provide in the cooling mode for intake of fresh air from the atmosphere through said compressor and intake of used air evacuated from the area to be cooled through said second chamber of said heat exchanger; and said second register is connected to the exhaust of said first air circuit and to the exhaust of said second air circuit to provide in the heating mode for the expulsion of the air discharged from said turbine into the atmosphere and the introduction of the air discharged from said second chamber of said heat exchanger into the area to be heated, and, to provide in the cooling mode for the introduction of the air discharged from said turbine into the area to be cooled and the explusion of the air discharged from said second chamber of said heat exchanger into the atmosphere.

5. An airconditioning system as defined by claim 1, wherein said first register is connected to the ends of said first air circuit to provide in the heating mode for intake of fresh air from the atmosphere through said turbine and introduction of the air discharged from said compressor into the area to be heated, and in the cooling mode to provide for intake of the used air from the area to be cooled through said turbine and explusion of the air discharged from said compressor into the atmosphere; and said second register is connected to the ends of said second air circuit to provide during the heating mode for intake of the used air from the area to be heated through said second chamber, and during the cooling mode to provide for intake of fresh air from the atmosphere through said second chamber and introduction of the air discharged from said second chamber into the area to be heated.

6. An airconditioning system as defined by claim 1 wherein the air discharged from said compressor is passed through an air-water heat exchanger where it gives up part of its heat to generate hot water.

7. An airconditioning system as defined in claim 1 wherein:

said first register is connected to the intake of said first air circuit and to the intake of said second air circuit;

said second register is connected to the exhaust of said first air circuit and to the exhaust of said second air circuit; and wherein said registers are movable between operational positions such that, in a first operational position for heating the area, air within the area is circulated through the first register and through the second air circuit and is discharged through the second register into the atmosphere while the fresh air form the atmosphere is circulated through the first register and through the second air circuit and is discharged through the second register into the area to be heated, and in a second operational position for cooling the area, air within the area is circulated through the first register and through the first air circuit and is discharged through the second register into the atmosphere while the fresh air from the atmosphere is circulated through the first register and through the second air circuit and is discharged through the second register into the area to be cooled.

8. An air conditioning system for residential use comprising:

a first air circuit having an intake and an exhaust and including a compressor unit in series with a first chamber of a heat exchanger and a turbine;

a second air circuit having an intake and an exhaust and comprising a second chamber of said heat exchanger;

first and second air intake conduits connected, respectively, to intake air from the atmosphere and from an area to be cooled or heated;

first and second air explusion conduits connected, respectively, to expel air into the atmosphere and into the area to be cooled or heated;

first register means connected to the intakes of the first and second air circuits and to said first and second air intake conduits for selectively controlling the intake of air from the atmosphere and from the area to be cooled or heated through the first and second air circuits, second register means connected to the exhausts of the first and second air circuits and to said first and second air expulsion conduits for selectively controlling the expulsion of air to the atmosphere and to the area to be heated or cooled through the first and second air circuits, said first and second register means being controlled so that air intake through the second air intake conduit from the area to be cooled or heated passes through one of the first and second air circuits and is expelled into the atmosphere through the first air expulsion conduit and so that air intake through the first air intake conduit from the atmosphere passes through the other of the first and second air circuits and is expelled into the area to be cooled or heated through the second air expulsion conduit, whereby air flow into and out of the area to be cooled or heated is always in the same direction through the air expulsion and intake conduits associated with said area.

9. An airconditioning system as defined by claim 8 wherein a humidifier is placed in one of said air circuits.

10. An airconditioning system as defined by claim 9 wherein said heat exchanger is divided into several sections between two of which is placed said humidifier.

11. An airconditioning system as defined by claim 9, wherein said humidifier is placed downstream of said compressor in said first air circuit.

12. The airconditioning system of claim 8 wherein said first air circuit includes said compressor unit, said first chamber and said turbine in series in that sequence in the direction of air flow through said first air circuit.

13. The airconditioning system of claim 8 wherein said first air circuit includes said turbine, said first chamber and said compressor in series in that sequence in the direction of air flow through said first air circuit.

14. An air conditioning system suitable for residential use comprising:

a first air circuit including a compressor unit in series with a first chamber of a heat exchanger and a turbine;

a second air circuit comprising a second chamber of said heat exchanger;

first and second registers connected to the ends of said two air circuits, each register having four orifices and two operational positions; and means for moving said first and second registers to first and second operational positions to respectively heat and cool an area wherein in the first operational position of the registers, used air is withdrawn from the area to be heated and passes in series through said first register, through one of the air circuits and through said second register for discharge into the atmosphere and fresh air drawn from the atmosphere passes through said first register, through the other of the air circuits and through said second register for discharge into the area to be heated, and in the second operational position of the registers, used air is withdrawn from the area to be cooled and passes through said first register, through the other of the air circuits and through said second register, and air drawn from the atmosphere passes through said first register, through said one of the air circuits and through said second register for discharge into the area to be cooled.

15. An air conditioning system as defined in claim 14 in which said one of the air circuits comprises said first air circuit, the air flow passing in sequence through the compressor, the first chamber and the turbine, and wherein said other of the air circuits comprises said second air circuit.

16. An air conditioning system as defined in claim 14 in which:

said one of the air circuits comprises said second air circuit and wherein said other of said air circuits comprises said first air circuit, the air flow passing in sequence through the turbine, the first chamber and the compressor of said first air circuit.

* * * * *